United States Patent [19]

Stone

[11] Patent Number: 4,949,933

[45] Date of Patent: Aug. 21, 1990

[54] DOCUMENT HOLDER FOR COMPUTER KEYBOARD

[76] Inventor: Earlyn Stone, P.O. Box 18, 33900 Sanwood Rd., Nuevo, Calif. 92367

[21] Appl. No.: 342,339

[22] Filed: Apr. 24, 1989

[51] Int. Cl.[5] ..... B41J 11/02

[52] U.S. Cl. ..... 248/442.2; 248/231.4; 248/918

[58] Field of Search ..... 248/442.2, 1 B, 231.4, 248/231.6, 229, 442.2, 231.2, 918; 400/718, 718.1; 211/45

[56] References Cited

U.S. PATENT DOCUMENTS

| | | | |
|---|---|---|---|
| 1,685,041 | 9/1928 | Binkele | 248/442.2 |
| 3,939,986 | 2/1976 | Pierro | 248/231.4 X |
| 4,141,524 | 2/1979 | Corvese, Jr. | 248/231.4 X |
| 4,767,093 | 8/1988 | Jones | 248/442.2 |

FOREIGN PATENT DOCUMENTS

| | | | |
|---|---|---|---|
| 371611 | 6/1921 | Fed. Rep. of Germany | 248/442.2 |
| 523150 | 7/1940 | United Kingdom | 248/442.2 |

*Primary Examiner*—David L. Talbott
*Assistant Examiner*—Daniel Hulseberg
*Attorney, Agent, or Firm*—Plante, Strauss, Vanderburgh & Connors

[57] ABSTRACT

There is disclosed a document holder having a clip to secure one or several pages of a document, supporting the pages in a convenient position adjacent a computer keyboard, typewriter, and the like. The document holder has a universal base which is formed of first and second angle members that are joined along their vertical surfaces to form a channel. The horizontal sides are grooved their entire length and receive a coextensive relatively stiff but resilient strap. Each of the straps receives a continuous band of an elastic and resilient cushion that is coextensive its length. The angle members are joined with screw fasteners extending through aligned apertures in the vertical sides of the angles with the apertures of at least one of the angle members being elongated to provide adjustability in the width of the assembled channel of the base. The document clip is supported on an arm that is pivotally secured to the back side of the assembled channel by an angle bracket that is pivotally mounted to the channel thereby permitting the arm to be moved freely through a plane that is normal to the plane of the keyboard which is received within the channel.

8 Claims, 3 Drawing Sheets

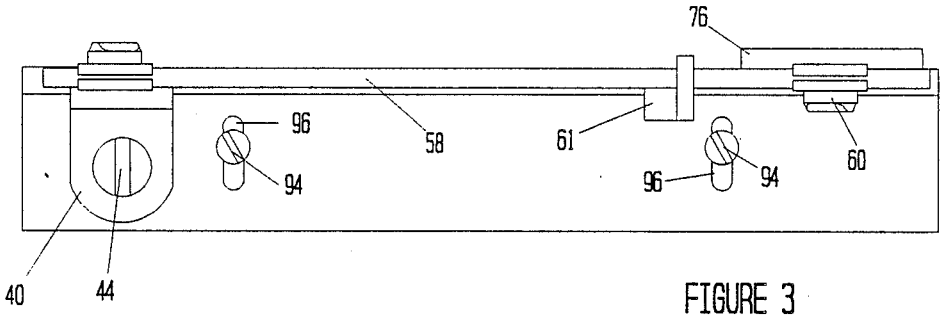
FIGURE 3
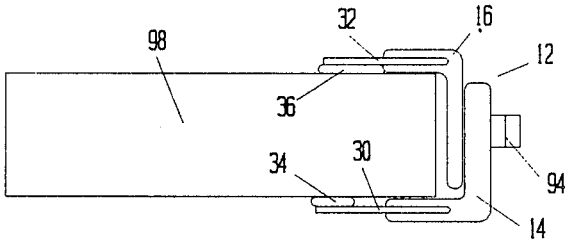
FIGURE 4
FIGURE 5
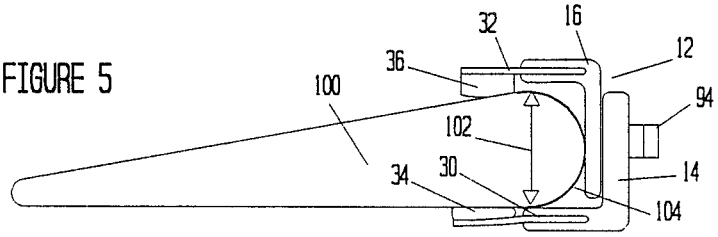

DOCUMENT HOLDER FOR COMPUTER KEYBOARD

BACKGROUND OF THE INVENTION

1. Field of Invention This invention relates to a document holder and, in particular, to a document holder for use with a computer keyboard.

2. Brief Statement of the Prior Art

Document holders for typists have been provided in many different forms. In many of these applications, the document is held or clipped to a board which is supported by a stand that is either free standing or is clamped to the edge of a desk top. These document holders are not well suited for computer applications because the computer base and monitor are quite bulky and limit the space available to support the document holder. Additionally, the computer monitor must be located in a convenient line of sight for the user, further complicating the requirements for an acceptable document holder.

Some document holders have been designed specifically for use with computers. One very simple document holder comprises a clip which is secured to one side of the monitor and which supports a document. Another document holder is incorporated into a keyboard cover that is hinged for pivoting into an upright position to uncover the keyboard and serve as a document holder.

None of the document holders truly meets the requirements for a universally adjustable and stable document holder. While it is desirable to provide a base that can be attached to the keyboard of a computer, there is no standard of size and shape of keyboards for computers. Accordingly, it is difficult to provide a truly universal base that will fit all or substantially all of the existing keyboards. Additionally, it is desirable that the base also have adaptability to clamp to the edges of table tops and desks, thereby increasing its versatility.

OBJECTIVES OF THE INVENTION

It is an object of this invention to provide a document holder suitable for use with computer keyboards.

It is a further object of this invention to provide a document holder having a base that will clamp to a computer keyboard.

It is an additional object of this invention to provide a base for a document holder that can be clamped to a computer keyboard and to edges of desk tops.

It is a further object of this invention to provide a document holder having a standard which can be adjusted to any position within a plane that is normal to the plane of the keyboard.

It is also a further object of the invention to provide a standard for a keyboard holder that can be adjusted in any position within any of a plurality of planes which are orthogonal to the plane normal to the keyboard.

It is a further object of this invention to provide a base clamp for a document holder which can fit bases having cross sections of parallelograms, triangles or irregular polygons.

BRIEF DESCRIPTION OF THE INVENTION

This invention comprises a document holder having a clip to secure one or several pages of a document, supporting the pages in a convenient position adjacent a computer keyboard, typewriter, and the like. For this purpose, the document holder has a universal base which is formed of first and second angle members that are joined along their vertical surfaces to form a channel. The horizontal sides are grooved their entire length and receive a coextensive relatively stiff but resilient strap. Each of the straps receives a continuous band of an elastic and resilient cushion that is coextensive its length. The angle members are joined with screw fasteners extending through aligned apertures in the vertical sides of the angles with the apertures of at least one of the angle members being elongated to provide adjustability in the width of the assembled channel of the base.

The document clip is supported on an arm that is pivotally secured to the back side of the assembled channel by an angle bracket that is pivotally mounted to the channel thereby permitting the arm to be moved freely through a plane that is normal to the plane of the keyboard which is received within the channel. Preferably the support arm is also pivotally secured to the angle bracket by an attachment clamp permitting its free movement through any of a plurality of planes which are orthogonal to the plane of movement of the support arm. The support clip is also pivotally secured to the free end of the arm so that it can be pivoted to orient the document in any desired position.

BRIEF DESCRIPTION OF THE DRAWINGS

The invention will be described with reference to the FIGURES of which:

FIG. 3 is a view of the back side of the base illustrating its adjustment capability; and FIGS. 4 and 5 are side views of the base of the document holder attached to various support bases.

DESCRIPTION OF PREFERRED EMBODIMENT

Figure 1:
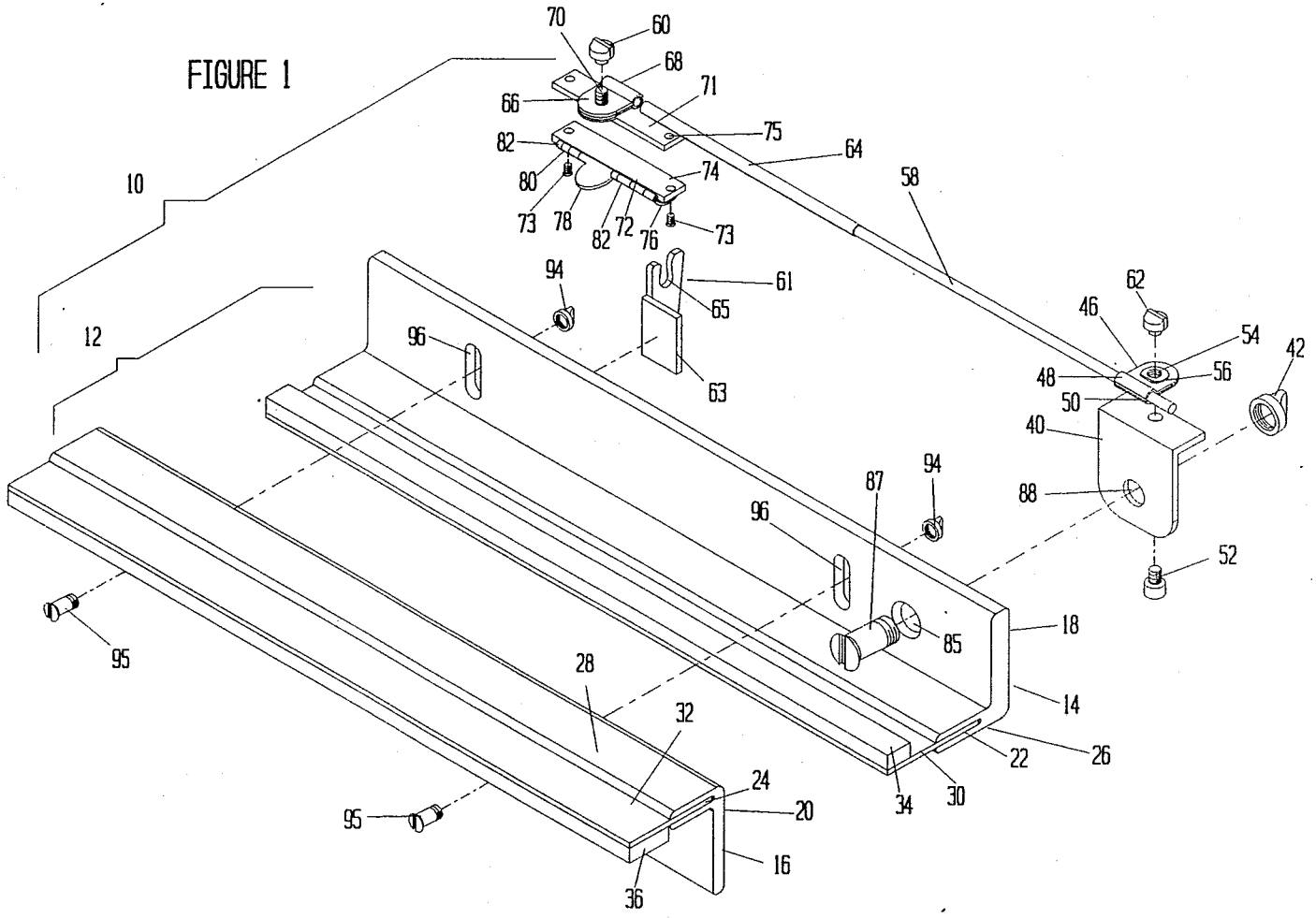
FIG. 1 is an exploded perspective view of the document holder.

The document holder 10 of the invention is shown in FIG. 1 in perspective view. The document holder 10 comprises a channel subassembly 12 of a first elongated angle 14 and a second elongated angle 16 which are substantially of equal length and which are joined along their vertical and opposed sides 18 and 20 by a plurality of screw fasteners 95 which extend through aligned apertures 96 in the vertical sides of the angles, and which receive thumb nuts 94. The fasteners 95 are received in countersunk apertures (not shown) of angle 16.

Each of the elongated angles has a coextensive groove 22 and 24 in its horizontal side 26 and 28. Each horizontal groove receives a resilient strap 30 or 32 which is permanently secured within its respective groove. Each strap has a coextensive resilient band 34 and 36 of elastic cushioning material. Preferably the widest band 36 is provided on the underside of the upper most strap 32 while the more narrow band 34 is provided along the outer edge of the upper surface of the lower most strap 30. These bands and straps extend into a compressive, clamping relationship on the upper and lower surfaces, respectively, of a keyboard or desk top, as shown in greater detail hereinafter. Attached to the back of side 18 of the angle 14 is an angle bracket 40. The angle bracket 40 is pivotally secured to the back side 18 of the angle 14, preferably by a screw fastener 87 which seats in a countersunk aperture 85 in the side 18 of the angle 14. The fastener extends through an aperture 88 in the bracket 40 and is caped with a thumb nut 42 having a large head to permit loosening and tightening of the fastener with one's fingers, thereby releasing or securing the position of the angle bracket 40 to the channel subassembly 12.

The angle bracket 40 supports, on its free side, a clamp 46 having a pair of opposed jaws 48 and 50 that are compressed together by a fastener 52 which extends through an aperture 54 in the clamp 46. Preferably the central area of the clamp is reinforced with a generally wedge-shaped shoulder 56 that surrounds the aperture 54 and provides a shoulder that is engaged by the shank of thumb nut 62 which engages the threaded end of fastener 52. The jaws 48 and 50 receive the elongated support arm 58. The elongated support arm 58 can be tubular or solid form and can, if desired, be an assembly of telescoping tubular rods. As illustrated, a single tubular rod is shown. The clamp 40 which secures one end of the rod to the angle bracket is secured to the bracket 40 with the single screw fastener 52 thereby permitting its pivotal movement on the angle bracket. The large head of the thumb nut 62 permits hand tightening of the clamp and its position on the bracket.

At its opposite and free end 64, the support rod 58 bears a second rod clamp 66 which also comprises a pair of plates having opposed jaws 68 along one side edge which receive the support arm 58, and a screw fastener 70 with a thumb nut 60 head to permit adjustment of the compression of the jaws 68 on the support arm 58.

A support plate 71 is also secured to the clamp 66 by the fastener 70, which passes through a central aperture (not shown) of the support plate 71. The support plate 71 has two internally threaded apertures 75, which are distally located and which receive fasteners 73. The fasteners 73 extend through apertures in the base 74 of document clasp 72 to secure the clasp 72 to the support plate 71 and rod clamp 66.

The clasp 72 is conventional in design and comprises a clamp plate 76 having a tab 78 and hinge blocks 80 along one side edge. The hinge blocks 80 cooperate with mating hinge blocks 82 of the clip base plate 74. The clamp plate 76 is provided with a torsion spring (not shown) which lies along the hinge axis to resiliently biases the clamp closed, thereby permitting the clamp to secure documents.

The rear surface of side 18 of angle 14 also receives a rod retainer bracket 61. This bracket is an angle with a base 63 which is bonded or welded to the rear of side 18. The other side of the angle bracket 61 extends above its base 63 and is bifurcated to provide a slotted recess 65. The slot 65 is slightly reduced in width at its mouth, thereby providing a snap retention of the end of rod 58.

Figure 2:
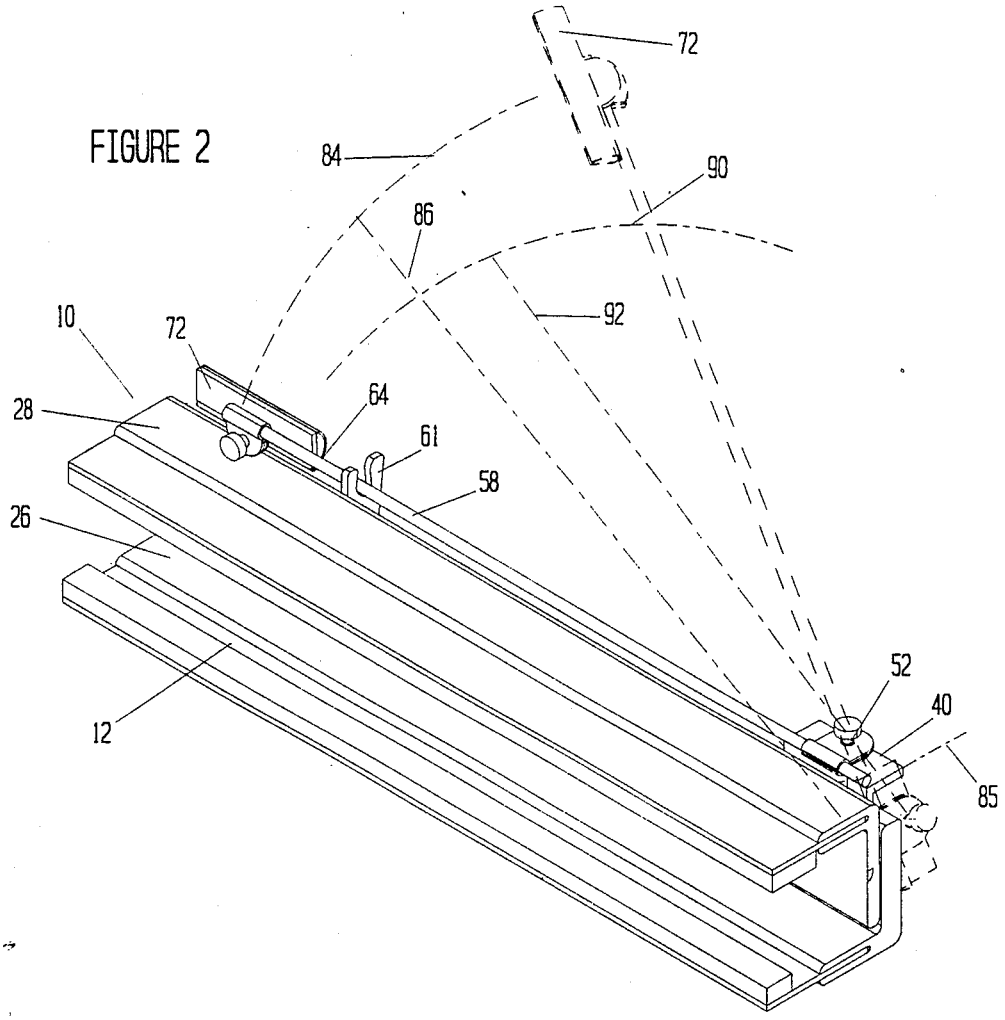
FIG. 2 illustrates the assembled document holder and shows the adjustability of the support arm of the document holder.

The document holder is shown in its assembled, and folded configuration in solid lines in FIG. 2. One of the features of the invention is the universal adjustability of the position of the position of the document clasp 72 of the document holder. For this purpose, the support arm 58 is freely moveable along an arc 84 on a radius 86 about the axis 85 of fastener 42. The arc 84 lies in a first plane that is generally orthogonal to the plane of a keyboard or other base that is received within the channel of the channel subassembly 12.

As the end of the support arm 58 is pivotally secured to the angle bracket 40 by a second pivotal connection, the support arm 58 is thus also free to move through along an arc 90 on radius 92 about the screw fastener 52. This arc 90 is orthogonal to the first arc and lies within a second plane. The arc 90 can lie along any number of planes with varied angular positions relative to the channel subassembly. In this manner, the free end 64 of the support arm 58 can effectively be oriented in an infinite number of positions relative to the keyboard and relative to the user.

As previously mentioned, the channel subassembly is adaptable to clamp to any variety of surfaces. As shown in FIG. 3, the subassembly is adjustable to vary the width of its channel by loosening the thumb nuts 94 of screw fasteners which extend through aligned apertures in the joined sides 18 and 20 of the angles. This permits spreading or contracting the width of the channel, as least one of each pair of aligned apertures 96 is elongated.

As shown in FIGS. 4 and 5, the document holder is adjustable to any of a variety of keyboard shapes or edges of desks and the like. The simple and direct adjustment of the base to a parallelogram cross section 98 as typically for the edge of a desk or table is shown in FIG. 4. The adaptability of the unit to fit a generally triangular crosssectional keyboard 100, as can be encountered in some keyboards is illustrated in FIG. 5. As there illustrated, the channel subassembly 12 has been constricted to be of substantially the same width as the upright leg 102 of the keyboard 100, and the resilient straps and bands exert an adequate clamping pressure on the opposite and mutually inclined top and bottom surfaces of the keyboard to provide the necessary stability to the unit. The keyboard 100 has a generally triangular cross-section with a maximum thickness along its rear edge 104 which has an arcuate surface. In this application also, the base unit can be adequately clamped by restricting the channel width and exerting a compressive force through the horizontal edges of the angle members and the resilient coextensive plates. The channel subassembly provides a very low profile, and the rod support and document clasp fold within this profile. This permits the document holder to be used on keyboards which are placed in keyboard drawers or slides, in which the vertical clearance is limited, often to less than 2.75 inches.

The document clasp is freely rotatable for a full 360 degrees of rotation about the screw fastener 52. In this manner, it is possible to provide an infinite number of positions of the document relative to the support arm which also can be positioned in an infinite number of positions relative to the keyboard. Thus, the document supported by the invention can be oriented at any of an infinite number of positions beside, above or in front of the keyboard thereby providing complete flexibility for the user.

Since the document holder is supported on the keyboard, it is very convenient for detached keyboards, which are often placed on the operator's lap, or moved about the desk. The document holder, and any documents supported thereon, is thus moved with the keyboard, insuring that it always supports the document in a easily readable location for the operator.

While the invention is intended primarily as a attachment and support for a document holder on computer keyboards, it is apparent that the unit can also be used with conventional other office equipment such as typewriters and the like, by clamping the base of the document holder to the edge of a desk or table.

The invention has been described with reference to the illustrated and presently preferred embodiment. It is not intended that the invention be unduly limited by this disclosure of the presently preferred embodiment. Instead, it is intended that the invention be defined, by the means, and their obvious equivalents, set forth in the following claims:

What is claimed is:

1. A document holder to support documents above a computer keyboard having a triangular cross section with a thick rear edge, narrow front edge and inclined top surface, which comprises:

a. an adjustable base formed from a pair of elongated angles having vertical and horizontal sides, with their vertical sides joined together to form an elongated channel which is received over the rear edge of said computer keyboard and which has a length to extend along the length of said computer keyboard, said angles being secured by assembly means comprising fasteners extending through apertures in said vertical sides with at least one of each pair of aligned apertures being elongated to provide adjustability in the width of said channel to accommodate variations in sizes of computer keyboards, and slots along the horizontal sides of each of said angles and received in each slot a stiff but yielding sheet extending outwardly from said slot and supporting a cushion band coextensive the length of each sheet to apply compressive attachment forces to the bottom and inclined top surface of said computer keyboard;

b. an angle bracket with one of its legs rotationally mounted on the backs of the joined vertical sides of said angles;

c. an elongated arm having a length substantially the same as said length of said elongated channel with one end thereof mounted to the other leg of said angle bracket;

d. a spring clip pivotally mounted to the opposite end of said elongated arm, with said angle bracket and spring clip being pivotal about axes normal to the joined vertical sides of said angles, whereby said elongated arm can be pivoted upwardly from the rear of said elongated channel to support a document above said computer keyboard.

2. The document holder of claim 1 wherein said elongated arm is mounted to said other leg of said angle bracket by pivot means permitting its pivotal movement about a second axis normal to the face of said other leg of said angle bracket.

3. The document holder of claim 1 wherein said elongated arm is an assembly of telescoping rods.

4. The document holder of claim 1 wherein said elongated arm is tubular.

5. The document holder of claim 1 wherein said elongated arm is secured to said angle bracket by a clamp having jaws at one end to receive said elongated arm and a screw fastener to tighten said jaws about said elongated arm.

6. The document holder of claim 1 wherein said spring clip is secured to said elongated arm with a clamp having jaws at one end to receive said elongated arm and a screw fastener to tighten said jaws about said elongated arm.

7. The document holder of claim 1 wherein said cushion band is a compressible, elastic material.

8. The document holder of claim 7 including two cushion bands comprising a first wide band adhered to the underside of the horizontal side of the uppermost of said angles, and a second band of lesser width than said first, and adhered to the upper side of the horizontal side of the lowermost of said angles.

* * * * *